US010684084B2

(12) United States Patent
Bratic

(10) Patent No.: US 10,684,084 B2
(45) **Date of Patent: *Jun. 16, 2020**

(54) LOW PRESSURE BOLT CARRIER GROUP

(71) Applicant: Saša Bratic, Tarpon Springs, FL (US)

(72) Inventor: Saša Bratic, Tarpon Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/538,840

(22) Filed: Aug. 13, 2019

(65) Prior Publication Data

US 2020/0124365 A1 Apr. 23, 2020

Related U.S. Application Data

(63) Continuation of application No. 16/178,534, filed on Nov. 1, 2018, now Pat. No. 10,378,839.

(60) Provisional application No. 62/579,890, filed on Nov. 1, 2017.

(51) Int. Cl.
*F41A 17/36* (2006.01)
*F41A 5/24* (2006.01)

(52) U.S. Cl.
CPC ..... *F41A 5/24* (2013.01)

(58) Field of Classification Search
CPC ..... F41A 3/26; F41A 5/18; F41A 5/24
See application file for complete search history.

(56) References Cited

U.S. PATENT DOCUMENTS

| | | | | |
|---|---|---|---|---|
| 5,551,179 | A * | 9/1996 | Young | F41A 3/12 42/16 |
| 10,139,181 | B1 * | 11/2018 | Wild | F41A 3/12 |
| 10,151,544 | B1 * | 12/2018 | Sugg | F41A 3/66 |
| 2005/0223613 | A1 * | 10/2005 | Bender | F41A 3/36 42/16 |
| 2014/0144314 | A1 * | 5/2014 | Jensen | F41A 3/64 89/193 |
| 2019/0072345 | A1 * | 3/2019 | Kramer | F41A 5/24 |

* cited by examiner

*Primary Examiner* — Gabriel J. Klein
(74) *Attorney, Agent, or Firm* — Aaron McGushion

(57) ABSTRACT

The present low pressure bolt carrier group is configured to maximize the axial force component, and minimize the radial force component, applied to both the bolt carrier and the bolt under low-pressure gas conditions, so that the two separate with greater acceleration and under greater force than a standard bolt carrier group when firing low-pressure ammunition. Thus, the present low-pressure bolt carrier group effectively and completely ejects the spent case and chambers the next round. These and other benefits are provided by the present low-pressure bolt carrier group comprising one or more of an increased piston bore diameter, an increased piston diameter, an increased flatness of the piston surface in the radial plane, and an increased stroke length of the piston by lengthening the cam pin slot. Therefore, the present low-pressure bolt carrier group solves long-persisting problems with standard bolt carrier groups when using low-pressure rounds.

12 Claims, 6 Drawing Sheets

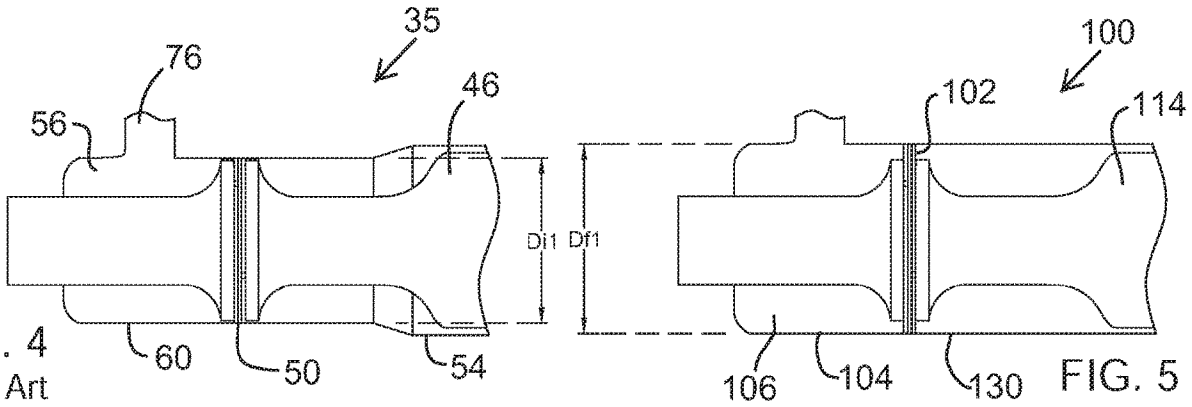
FIG. 4
Prior Art
FIG. 5
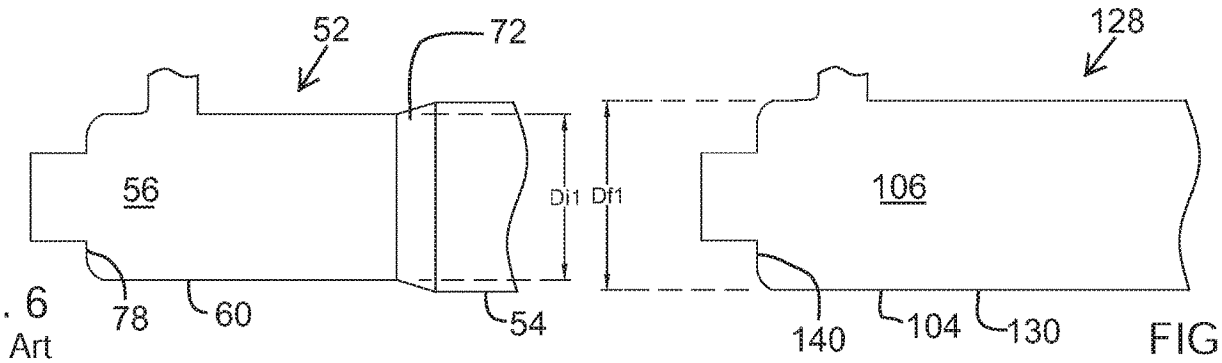
FIG. 6
Prior Art
FIG. 7
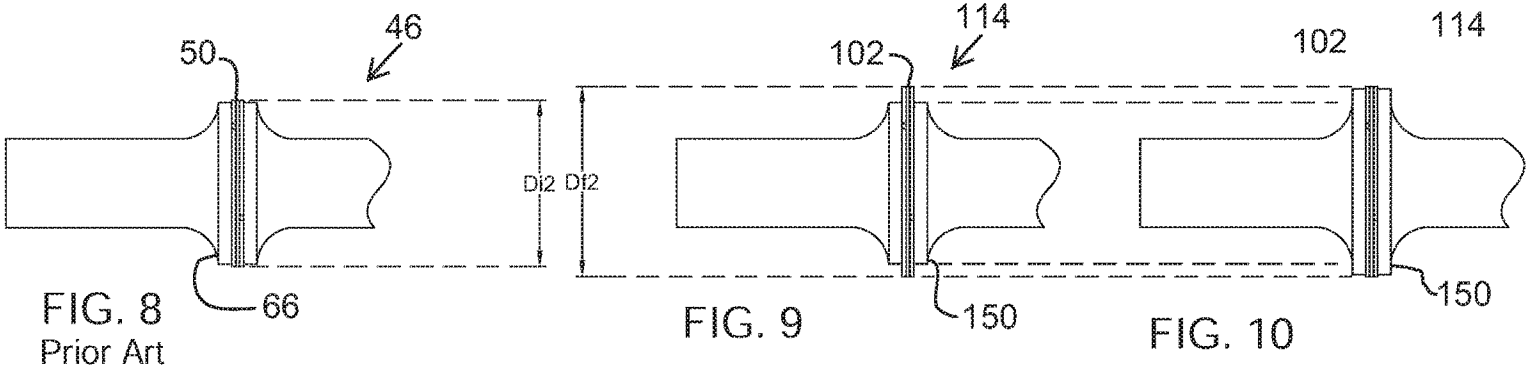
FIG. 8
Prior Art
FIG. 9
FIG. 10

LOW PRESSURE BOLT CARRIER GROUP

BACKGROUND

The AR-15 rifle is currently one of the most popular rifles in the US. As a result, a substantial industry has grown to produce and customize this platform in numerous ways. The rifle's modularity further lends itself to extensive customization, since aftermarket parts and accessories are easily installed. Although the AR-15 was originally designed for the 5.56 mm NATO rifle cartridge or the .223 Remington rifle cartridge, the platform may be modified to accept multiple calibers and different loads of propellant.

In competition shooting, as well as other various uses, a low-pressure subsonic caliber and/or load cartridge may be preferred by some. However, low-pressure rounds may cause cycling issues in semi-automatic or automatic rifles. For example, referring to the exploded illustration of an existing standard AR-15 in FIGS. 1A-C, the spent case may not properly eject from the rifle 20. Or, the rifle will eject the spent case, but will fail to chamber the next round. These issues are primarily due to low pressure gases flowing from the gas port of the barrel 26, through the gas tube 36, and into the gas key 38 carry insufficient force to effectively and fully push the bolt 46 apart from the bolt carrier 44, where the bolt 46 captively slides within a bolt bore formed longitudinally into the bolt carrier 44 with the cam pin 42 limiting the travel of the bolt 46. Further, the low pressure discharge or port gasses are insufficient to force the bolt carrier 44 fully back so that the spent round is discharged and a new round chambered by the extractor 48. A cylinder chamber is defined between the bolt bore and the bolt 46, with a seal created between the bolt bore and the bolt 46 through the use of one or more bolt gas rings 50. A firing pin 40 moves axially within the bolt carrier assembly 35, through the bolt 46.

Looking further at FIGS. 1A-C, to more specifically define some of the standard parts and assemblies of a typical AR-15 rifle, the rifle 20 is comprised of, in pertinent part, a barrel 26 with a gas block 32 for guiding discharge gas from a port in the barrel 26 and into the gas tube 36. In the barrel assembly 34, a hand guard 30 protects the user from heat generated by the barrel 26. The rifle 20 further includes an upper receiver 22, a lower receiver 24, and a stock 28.

Since low-pressure rounds often provide insufficient gas for proper cycling of a standard bolt carrier group 35, what is needed is a device, a system, and/or a method to provide proper cycling while still providing the benefits of a low-pressure ammunition round.

SUMMARY

A low pressure bolt carrier device or assembly or group is provided, comprising a bolt comprising a piston flange formed about a bolt body, the piston flange having an outer circumferential edge and a bolt tail axially extending from a center portion of the piston flange, a piston surface defined between an outer surface of the bolt tail and the outer circumferential edge; a bolt carrier comprising a continuous diameter bolt bore defining a side wall and a bottom wall, a gas key passage configured to deliver discharge gas into the continuous diameter bolt bore, a cam slot formed through the wall having a top slot portion formed on a top of the bolt carrier; where, when assembled, the bolt is axially positioned within the continuous diameter bolt bore defining a cylinder chamber between the piston surface and the bottom wall and side wall of the continuous diameter bolt bore, the bolt configured to be restricted to reciprocal axial movement over a stroke distance; and where the top slot portion of the cam slot has a slot length sufficient to provide clearance to enable reciprocal axial movement of the bolt.

As an option, the stroke distance is between 0.65 inches and 0.8 inches; or the stroke distance is between 0.7 inches and 0.76 inches; or the stroke distance is between 0.73 inches and 0.75 inches.

As an option, at least 50% of the piston surface is flat and substantially perpendicular to the axial movement of the bolt; or at least 80% of the piston surface is flat and substantially perpendicular to the axial movement of the bolt; or at least 90% of the piston surface is flat and substantially perpendicular to the axial movement of the bolt.

As an option, a diameter of the continuous diameter bolt bore is at least 0.52 inches; or a diameter of the continuous diameter bolt bore is at least 0.53 inches; or a diameter of the continuous diameter bolt bore is between 0.52 inches and 0.54 inches.

BRIEF DESCRIPTION OF THE FIGURES

FIG. 4 is a partial cross-sectional schematic view of a simplified prior art bolt carrier group showing the standard bore cylinder wall;

FIG. 5 is a partial cross-sectional schematic view of the present low-pressure bolt carrier group showing the increased diameter bore cylinder wall in comparison with the prior art version of FIG. 4;

FIG. 6 is a partial cross-sectional schematic view of a simplified prior art bolt carrier showing the standard bore cylinder wall;

FIG. 7 is a partial cross-sectional schematic view of the present low-pressure bolt carrier showing the increased diameter bore cylinder wall in comparison with the prior art version of FIG. 6;

FIG. 8 is a partial cross-sectional schematic view of a standard simplified prior art bolt showing the standard bolt gas ring diameter;

FIG. 9 is a partial cross-sectional schematic view of the present low-pressure bolt showing the increased diameter bolt gas rings in comparison with the prior art of FIG. 8;

FIG. 10 is a partial cross-sectional schematic view of the present low-pressure bolt showing the increased bolt flange and/or increased diameter bolt gas rings in comparison with the prior art of FIG. 8;

DETAILED DESCRIPTION

The present device, and/or system, and/or kit, and/or modification, and/or retrofit, and/or method provides a unique low pressure bolt carrier group configured to maximize the axial force component, and minimize the radial force component, applied to both the bolt carrier and the bolt under low-pressure gas conditions, so that the two separate with greater acceleration and under greater force than a standard bolt carrier group when firing low-pressure ammunition. Thus, the present low-pressure bolt carrier group effectively and completely ejects the spent case and chambers the next round.

These and other benefits are provided by the present low-pressure bolt carrier group comprising one or more of an increased piston bore diameter, an increased piston diameter (the flange diameter and/or the gas ring diameter), an increased flatness of the piston surface in the radial plane, and an increased stroke length of the piston (and, thus, the bolt) by lengthening the cam pin slot. Therefore, the present low-pressure bolt carrier group solves long-persisting problems with standard bolt carrier groups when using low-pressure rounds.

Figure 1A:
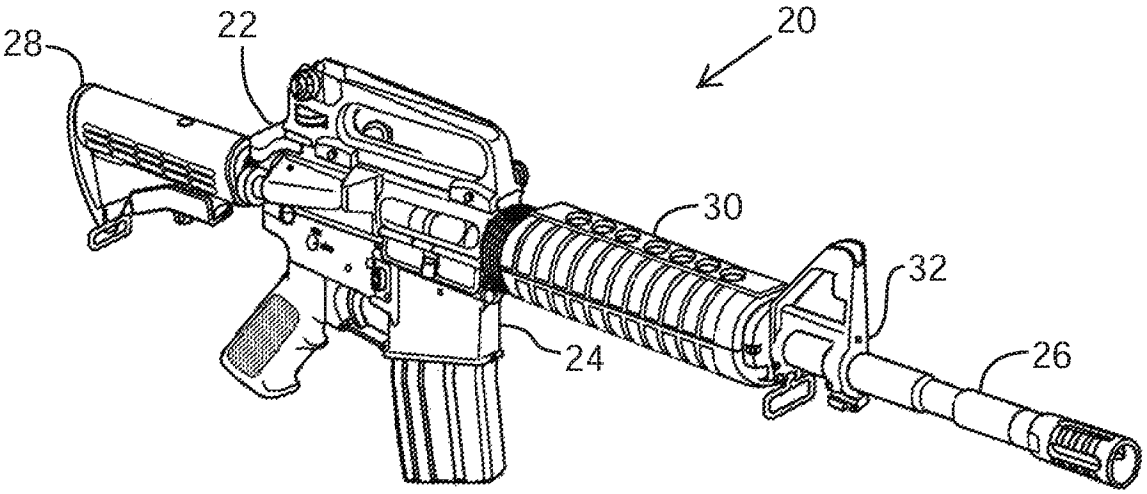
FIGS. 1A-C are perspective and exploded perspective illustrations of a standard prior art AR-15 or M16 rifle.
Figure 1C:
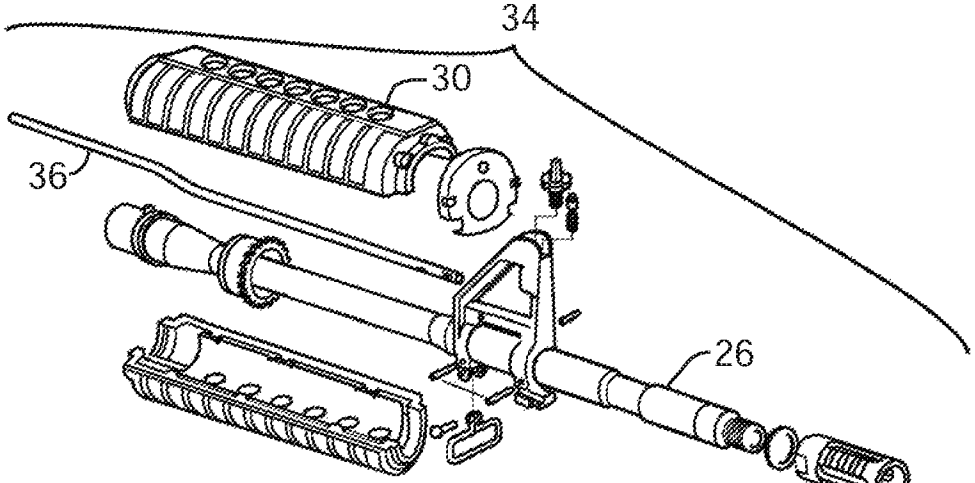
Figure 1B:
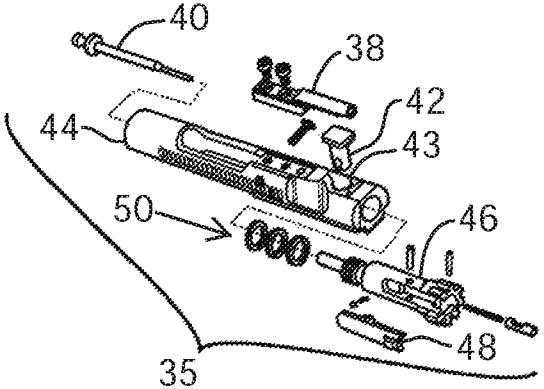
Figure 2A:
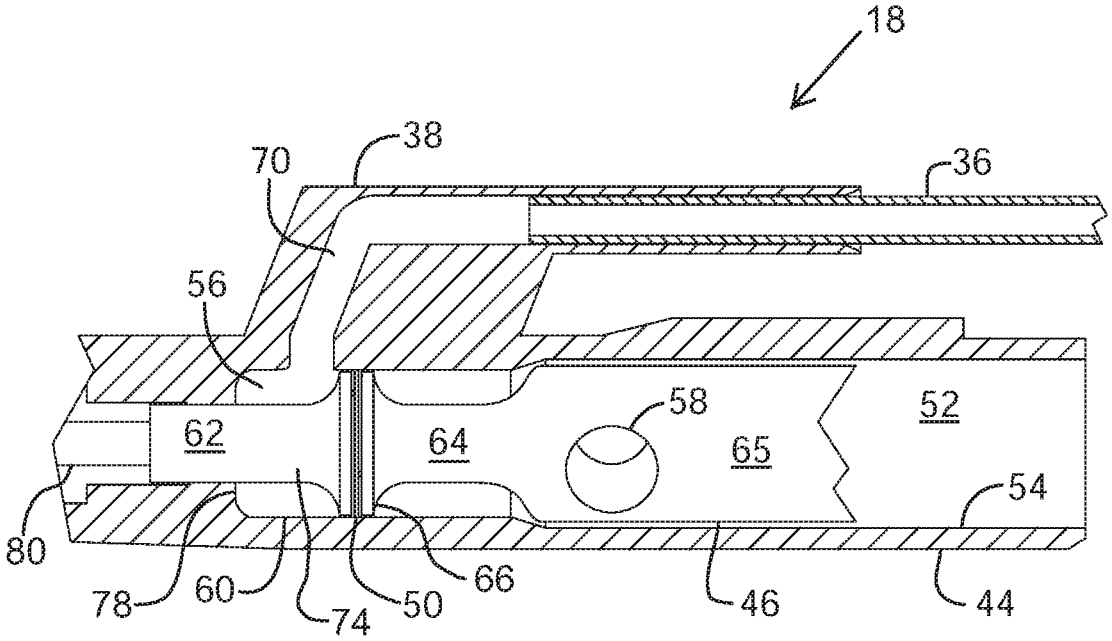
FIG. 2A PRIOR ART
FIGS. 2A-B are partial cross-sectional schematic views of a simplified prior art bolt carrier group showing basic operation and the standard stroke distance.
Figure 2B:
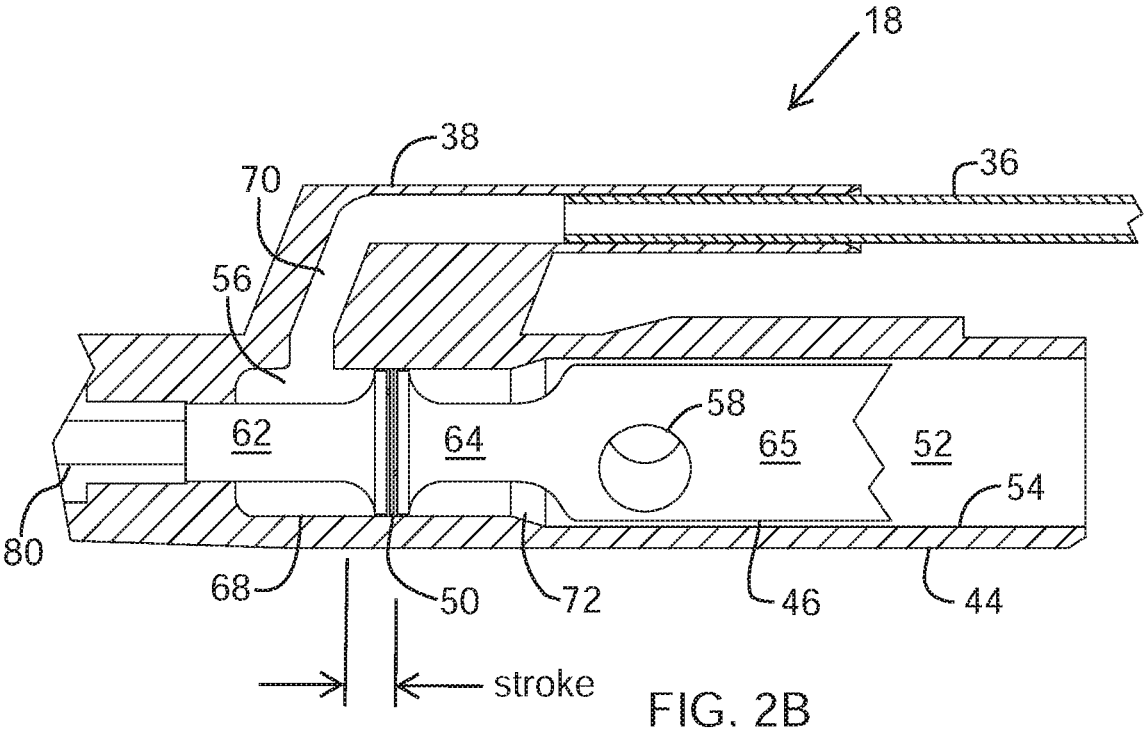
FIG. 2B PRIOR ART

Many of the unique improvements of the present low-pressure bolt carrier group are made relative to a standard bolt carrier group. Thus, to better understand its shortcomings, it is beneficial to first look at the operation and configuration of a standard bolt carrier group 18, as simply and schematically illustrated in FIGS. 2A and 2B, leaving out several parts and details not fully pertinent to the present explanation. FIG. 2A shows the standard bolt carrier group 18 in the initial configuration (when the cylinder chamber 56 is not substantially pressurized with discharged gas), with the piston surface 74 of the flange 66 located closest to the bottom wall 78 of the bolt bore 52, representing the position of minimum cylinder chamber 56 volume. FIG. 2B illustrates the bolt carrier group 18 after the injection of discharge gas into the cylinder chamber 56, with the piston surface 74 of the flange 66 located furthest to the bottom 78 of the bolt bore 52 as shown by the "stroke" dimension, representing the position of maximum cylinder chamber 56 volume, due to pressurized discharge gas pushing the bolt 46 to the viewer's right (e.g., toward the muzzle) and the bolt carrier oppositely to the viewer's left (e.g., toward the stock).

The standard bolt carrier group 18, as illustrated, is comprised of a bolt carrier 44, a gas key 38 (integral or attachable to the bolt carrier 44), a firing pin 80, and a bolt 46 positioned to axially slide within the bolt bore 52. A gas tube 36 carries discharge gas from the barrel to the gas key 38, injecting the discharge gas into the gas key passage 70 and into the cylinder chamber 56 through the port 76 providing fluid communication between the passage 70 and the chamber 56. The bolt 46 slides within the bolt bore 52, with gas piston rings 50 supported on the flange 66 and the gas piston rings 50 sealed against the cylinder wall 60, so that gas is sealed within the cylinder chamber 56 during expansion. The bolt 46 is generally turned from a solid metal (e.g., steel) rod, and further includes a bolt tail 62 that extends across the cylinder chamber 56, an annular flange 66 protruding from the proximal end of the bolt tail 62 (i.e., the bolt tail 62 protrudes from the annular flange) (the annular flange may also be referred to herein as the piston), a necked portion 64 on the opposite side of the flange 66, and a body portion 65 extending from the necked portion 64. The annular flange 66 transitions from the bolt tail 62 through a fillet 82 having a radius (0.125" R) that extends most, if not all (perhaps within several thousands of an inch of all), of the step between the bolt tail 62 and the annular flange 66. Thus, there little to no radially flat portion of the piston surface 74, that is, a planar surface extending perpendicularly to the cylindrical axis (axial direction) of the bolt 46. About the outer circumference of the annular flange 66 is formed an annular groove in which one or more gas rings 50 are trapped. A cam pin bore 58 is formed through the body portion 65 for holding therein the cam pin 42 (shown in later illustrations). The standard bolt bore 52 is a counterbore with the smaller bore (at the bottom of the larger bore) forming the cylinder wall 60 and the larger bore (at the mouth of the bore) forming the bolt bore wall 54, with a chamfer 72 (which may also be referred to herein as a tapered portion) transitioning between the two bore diameters.

Standard bolt carrier assemblies 18 share substantially the approximate same dimension or relative sizes. Standard dimensions include: piston (flange) diameter=0.488", the cam slot diameter=0.3165" (just the circular hole portion of the slot at the top 161 of the bolt carrier within which the cam pin 42 slides when cycling a round), centered 0.640" from the bore mouth end of the bolt carrier; the bolt gas ring diameter=0.512"; the bolt carrier bore diameter=0.5315" at 1.205" deep; and the cylinder wall diameter=0.500" ending at the bottom of the bore.

As explained above, there are many issues with the standard bolt carrier group 18 when firing ammunition that produces gases at much lower pressures than standard ammunition, such as failing to eject the spent case and failing to chamber the next round. The present low-pressure bolt carrier group 100, as illustrated in the embodiments of FIGS. 3A-B, 5, 7, 9, 10, 11, 13, 14, and 17-18 solves the negative performance aspects of the standard bolt carrier group 18.

Figure 3A:
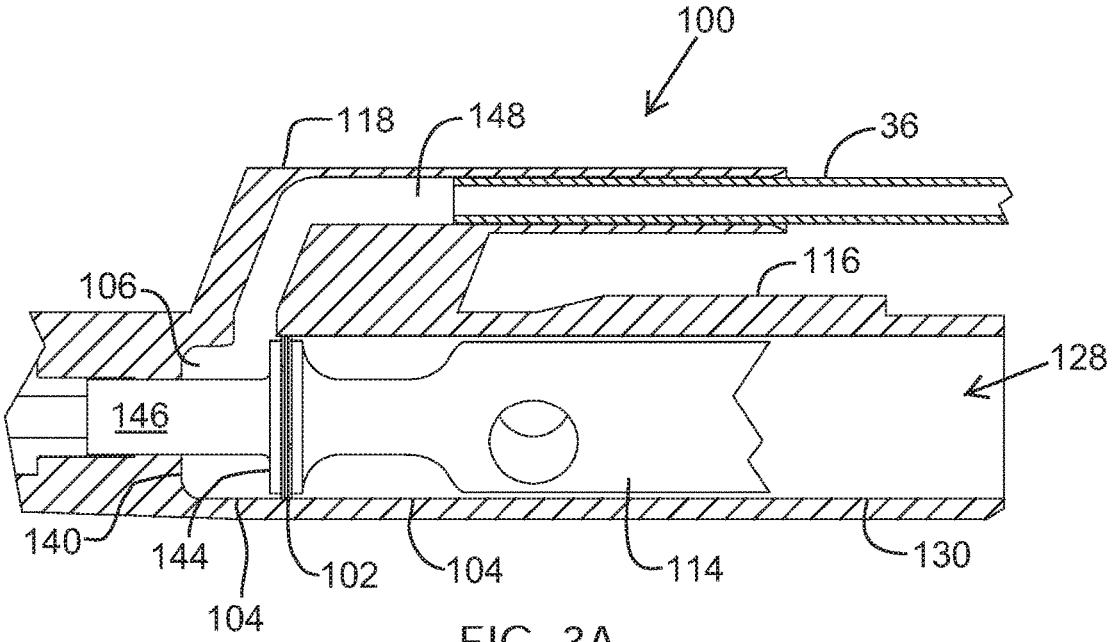
FIGS. 3A-B are partial cross-sectional schematic views of the present low-pressure bolt carrier group showing basic operation and the increased stroke distance.
Figure 3B:
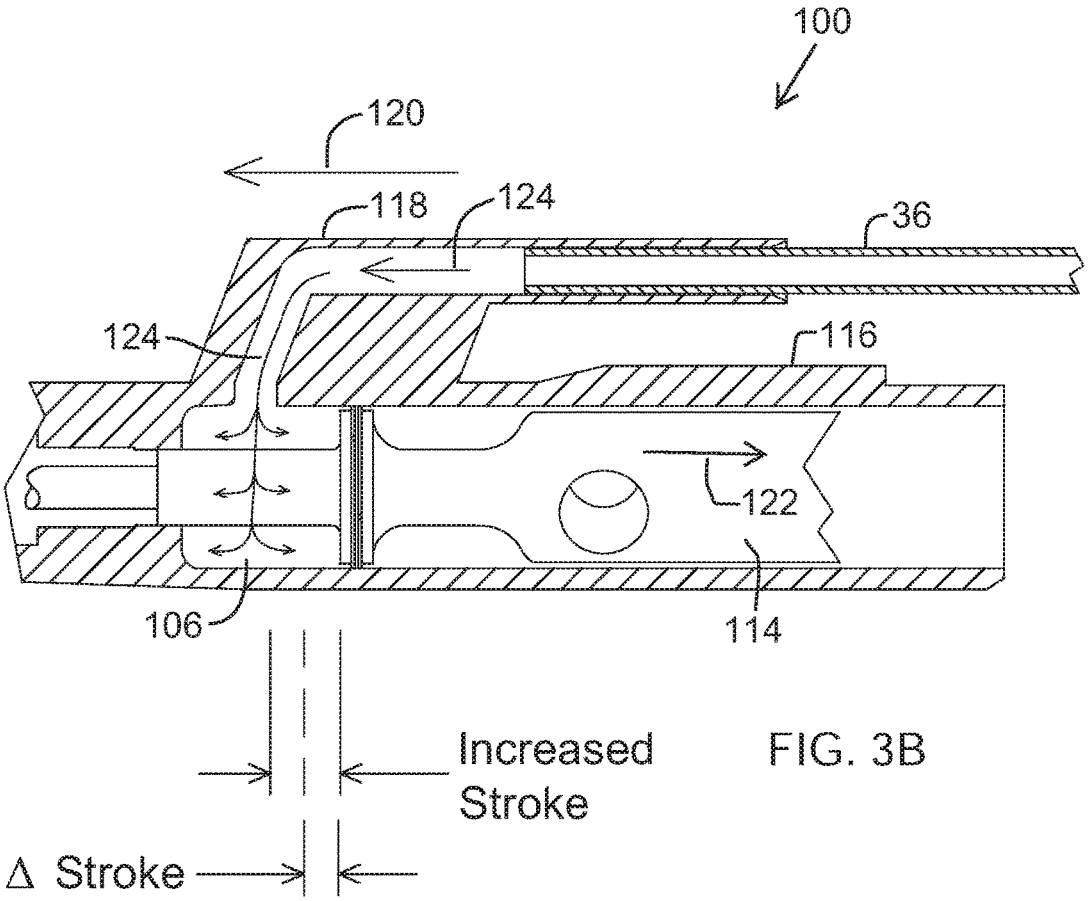

Looking first at FIGS. 3A-B, the present low-pressure bolt carrier group 100 (which may also be referred to herein as a "device") is illustrated schematically, showing several unique aspects of the present device 100. In this example embodiment of the low-pressure bolt carrier group 100, the low pressure bolt bore 128 is a constant diameter bore from the mouth to the bottom 140 of the bore 128, which forms a continuous or smooth-bored inner surface of the enlarged cylinder chamber 106. The constant diameter of the low pressure bolt bore 128 is preferably 0.5315", thus eliminating the counterbore and the chamfer of the prior art design. This is an exemplary bore diameter, and may vary in diameter by, for example, ±0.005", by up to ±0.008", by up to ±0.01", by up to ±0.013", by up to ±0.015", by up to ±0.018", by up to ±0.02", by up to ±0.023", by up to ±0.025", and by up to ±0.028". The diameter of the enlarged diameter gas rings 102 is preferably 0.5435" with a 0.052" gap in the ring to permit compression to fit within the low pressure bolt bore 128 when fitted within the annular groove of the low pressure bolt 114. This is an example gas ring diameter, and may vary in diameter by, for example, ±0.005", by up to ±0.008", by up to ±0.01", by up to ±0.013", by up to ±0.015", by up to ±0.018", by up to ±0.02", by up to ±0.023", by up to ±0.025", and by up to ±0.028". The diameter of the enlarged diameter cylinder (flange) 142 is preferably 0.5195". This is an example cylinder diameter, and may vary in diameter by, for example, ±0.005", by up to ±0.008", by up to ±0.01", by up to ±0.013", by up to ±0.015", by up to ±0.018", by up to ±0.02", by up to ±0.023", by up to ±0.025", and by up to ±0.028". Furthermore, in at least one embodiment, the cylinder may be kept at a standard of 0.488" (or smaller than standard diameter), while widening the annulus-shaped face of the gas rings by decreasing the inner diameter of the gas ring to fit within the standard annular groove. In yet another embodiment, the taper 72 is substantially reduced, leaving a smaller-than-standard stepdown between the bolt bore 52 and the counterbore comprising the chamber 56, such as a 0.005" step, or a 0.01" step, or a 0.015" step, or a 0.02" step.

As can be seen in FIG. 3A, one example embodiment of the low-pressure bolt carrier group 100 is generally comprised of a low-pressure bolt carrier 116 having a low-pressure bolt bore 128 formed axially therethrough for holding therein a low-pressure bolt 114. The enlarged bolt bore wall 130 is continuous (without a step down in diameter), although a step up or increase in diameter may be an option to further enlarge the diameter of the enlarged cylinder wall 104, but would require a potentially more costly undercut operation. The enlarged cylinder chamber 106 is defined by the bottom 140 of the bore 128, the piston surface 144, the enlarged cylinder wall 104, the annulus portion of the enlarged gas rings 102 exposed and extending from its annular groove. Due to the bolt tail 146 extending through the enlarged cylinder chamber 106, both the piston surface 144 and the bottom 140 have annulus-like profiles. Again, in this embodiment, the enlarged cylinder wall 104 is the same as the diameter of the bolt bore wall 130, as they would be created in the same boring and/or honing and/or reaming and/or broaching process. However, the enlarged cylinder wall 104 alone may be polished (leaving the bolt bore wall 130 unpolished or less polished or with a rougher finish), such that the diameter is slightly larger, as material is removed for polishing.

By increasing the diameter of the enlarged cylinder wall 104, one or both of and increasing the piston surface 144 area (by increasing overall diameter) and increasing the diameter the enlarged diameter gas ring 102 diameter, the discharge gas 106 acts on a much larger surface area of both the bottom 140 and the combination of the piston surface 144 and/or the gas ring 102 exposed surface. In this way, (using the basic formula F=P·A) because the surface areas of the bottom 140 and one or both of the piston surface 144 and the gas ring 102 exposed surface, the lower pressure produces a higher force. The higher force more effectively separates the bolt carrier 116 from the bolt 114 (as shown in FIG. 3B) and enables correct cycling (including unlocking, extracting, ejecting, cocking, feeding, chambering, and locking), even with lower-pressure discharge gas 124 produced by low-pressure rounds.

Looking more at FIG. 3B, the low pressure bolt carrier group 100 is shown after the rifle is fired, and as the discharge gas flows back through the gas key passage 148, and enters the chamber 106. The bolt carrier 116 is forced toward the butt of the rifle (as indicated directionally by arrow 120), while the bolt 114 is forced forward toward the muzzle of the rifle (as indicated directionally by arrow 122), increasing the volume of the cylinder 106 by separating the bottom 140 of the bore 128 from the piston surface 144. After the bolt 114 axially travels forward relative to the bolt carrier 116, both the bolt 114 and the bolt carrier travel back toward the butt together. The stroke is shown with extension lines, with the leftmost extension line representing the initial configuration before firing the rifle, and the middle dashed extension line representing the standard stroke length, and the rightmost extension line representing the "increased stroke" length, which will be described in further detail below. As seen by the "A stroke" dimension, the increased stroke length is substantially more than a standard stroke length, for example, the change in stroke can be more than 0.1", or more than 0.09", or more than 0.08", or more than 0.07", or more than 0.06", or more than 0.05", or more than 0.04". In one or more embodiments, the total increased stroke distance (or length) is between 0.65" to 0.70", or between 0.70" to 0.75", or between 0.75" to 0.80", or between 0.72" to 0.76", or between 0.73" to 0.76", or between 0.74" to 0.75", or between 0.73" to 0.75". The new increased stroke distance is substantially longer than the existing 0.637" stroke distance, being between 10% and 20% longer, or between 12% to 18% longer, or between 14% and 16% longer, or between 15% and 16% longer.

Turning now to FIGS. 4-10, a physical comparison is made between the prior art system (in FIGS. 4, 6, and 8) to several aspects of the present system (in FIGS. 5, 7, 9, and 10), schematically illustrated side-by-side. FIG. 4 shows the standard bolt carrier group 35, where the smaller internal diameter cylinder wall 60 diameter is measured as $D_{i1}$; and FIG. 5 shows the present bolt carrier group 100, where the larger internal diameter cylinder wall 104 diameter is measured as $D_{f1}$. It can be seen in FIGS. 5 and 7, that $D_{f1}$ is substantially larger than $D_{i1}$, which permits larger diameter gas rings 102 and/or a larger diameter piston 150 (FIG. 10) and a larger diameter bottom surface 140, for permitting the application of greater force upon the piston surface 144 and the bottom 140, even with low-pressure gas. The prior art cylinder chamber 56 diameter $D_{i2}$ of FIG. 6 is compared with the present enlarged cylinder chamber 106 diameter $D_{f2}$, where the cylinder chamber diameter is more than 0.50", or more than 0.51", or more than 0.52", or more than 0.53", or more than 0.54". For example, the enlarged cylinder chamber 106 diameter $D_{f2}$ is, in at least one example embodiment, is between 0.53" and 0.54", or is between 0.52" and 0.53", or is between 0.51" and 0.52". The enlarged cylinder chamber 106 volume is increased, compared to the prior art volume, in at least one embodiment, by more than 5%, or by more than 7%, or by more than 10%, or by more than 12%, or by more than 14%, or by more than 15%, or by more than 16%, or by more than 18%. In at least one embodiment, the chamber volume is increased, compared to the prior art volume, or between 13% and 17%, or between 14% and 16%, or between 15% and 16%, or between 15% and 17%.

Figure 11:
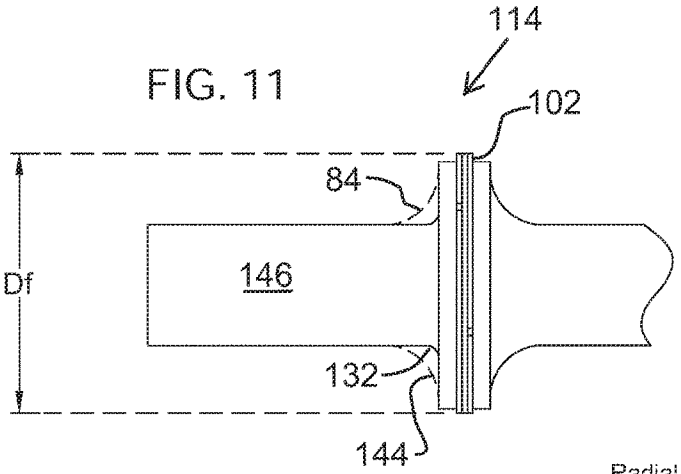
FIG. 11 is a partial plan schematic view of the present bolt with increased gas ring diameter and decreased fillet radius.

FIG. 11 illustrates the low-pressure bolt 114 in which the components of the piston surface 144 which are planar perpendicular to the axial axis and parallel to the radial axis are maximized, such that the annulus or circular ring-shaped piston surface 144 is primarily flat, save for a minimal fillet 132, chamfer, or other equivalent stress reliving feature that minimizes stress risers at the intersection of the piston surface 144 and the bolt tail 146 (if required). In at least one embodiment, at least 40% of the piston surface 144 is flat and substantially perpendicular to the axis of travel of the bolt 114, or at least 50% of the piston surface 144 is flat and substantially perpendicular to the axis of travel of the bolt 114, or at least 60% of the piston surface 144 is flat and substantially perpendicular to the axis of travel of the bolt 114, or at least 70% of the piston surface 144 is flat and substantially perpendicular to the axis of travel of the bolt 114, or at least 80% of the piston surface 144 is flat and substantially perpendicular to the axis of travel of the bolt 114, or at least 90% of the piston surface 144 is flat and substantially perpendicular to the axis of travel of the bolt 114, or at least 100% of the piston surface 144 is flat and substantially perpendicular to the axis of travel of the bolt 114.

Figure 12:
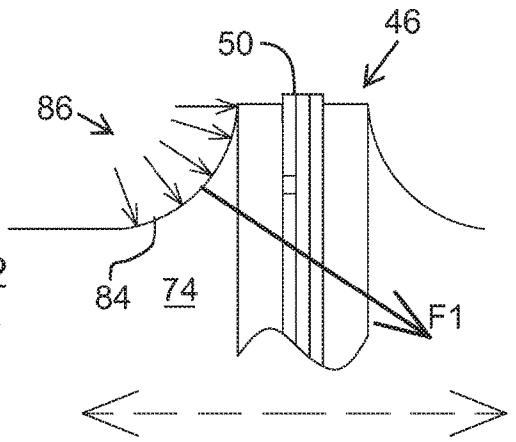
FIG. 12 Prior Art
FIG. 12 is a partial plan schematic view of prior art bolt with a standard gas ring diameter and standard fillet radius.

Maximizing the surface of the piston surface 144 that is planar perpendicular to the axial axis is achieved by one or both of minimizing radius of or substantially eliminating the fillet 132 (i.e., zero or near zero radius) between the flange of the piston 156 and the outer diameter of the bolt tail 146. The standard fillet 84 is shown in dashed lines in FIG. 11, compared to the reduced radius fillet 132. FIG. 12 illustrates the inefficiencies of the standard large radius fillet 84. The distributed force of the gas 86 acts perpendicular to the curved piston surface 74, such that a portion of the gas force produces a force component in the axial direction, while a large portion of the gas force additionally produces a force component in the radial direction, creating a resultant force $F_1$ transverse to the axis of the bolt 46. The only component of the force that produces axial movement of the bolt carrier 44 and the bolt 46 is the axial component, while the radial component does not contribute to axial movement and, instead, creates internal stress. In at least one embodiment, at least 50% of the force incident on the piston surface 144 is directed axially, or at least 60% of the force incident on the piston surface 144 is directed axially, or at least 70% of the force incident on the piston surface 144 is directed axially, or at least 80% of the force incident on the piston surface 144 is directed axially, or at least 90% of the force incident on the piston surface 144 is directed axially, or at least 95% of the force incident on the piston surface 144 is directed axially, or 100% of the force incident on the piston surface 144 is directed axially. Because the present bolt 114 is designed for use with firing low-pressure rounds which produce minimal stress on components, a fillet may not be required. In the case where there is no fillet or other stress relieving feature (save for any inherent feature created by the imperfect shape of the cutting tool tip), 95% to 99% or up or approaching 100% of the force incident on the piston surface 144 is directed axially.

Figure 13:
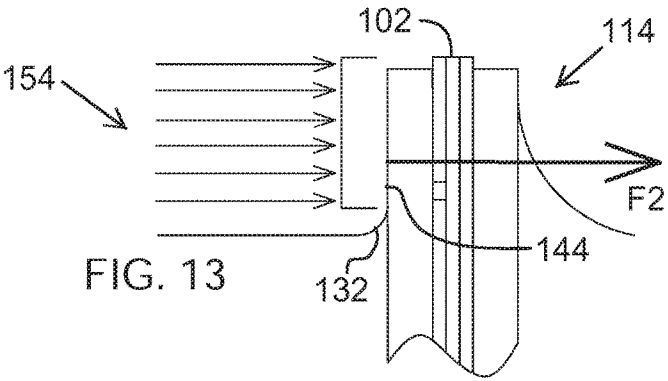
FIG. 13 is a partial plan schematic view of the present bolt with increased gas ring diameter and decreased fillet radius.

FIG. 13 illustrates a minimized fillet radius 132, which creates a large planar surface (annulus surface) perpendicular to the axial axis and parallel to the radial axis. The fillet 132 can be completely eliminated to create a square shoulder (not illustrated). However, a small fillet may be desired to reduce stress concentrations at the transition between the bolt tail 146 and the flange of the piston 156. Thus, the fillet 132 should have a radius sufficient to resist cracking under loads expected with low-pressure applications. The increased piston surface 158 (surface that may be acted upon by the axial force component) and the minimized fillet 132 maximize the application of force in the axial direction. Thus, the resultant force ($F_2$) can be nearly parallel (e.g., less than 3°, or 5°, or 10° of parallel), or substantially parallel (e.g., within 10 or 2° of parallel), or parallel with the axial direction (e.g., less than 1° from parallel). In this way, a large proportion of the gas force is directed in the axial direction, so that low-pressure gas still produces a large force component in the axial direction. The percentage of the piston surface 158 that may be acted upon by the axial force component is preferably increased over the standard piston surface 74 by up to 5%, by up to 8%, by up to 10%, by up to 13%, by up to 15%, by up to 18%, by up to 20%, by up to 23%, by up to 25%, by up to 28%, and by up to 30%.

Figure 14:
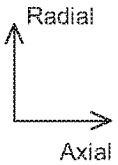
FIG. 14 illustrates a schematic partial cross-sectional view of the present low pressure system shown in relation to a standard gas block.
Figure 14:
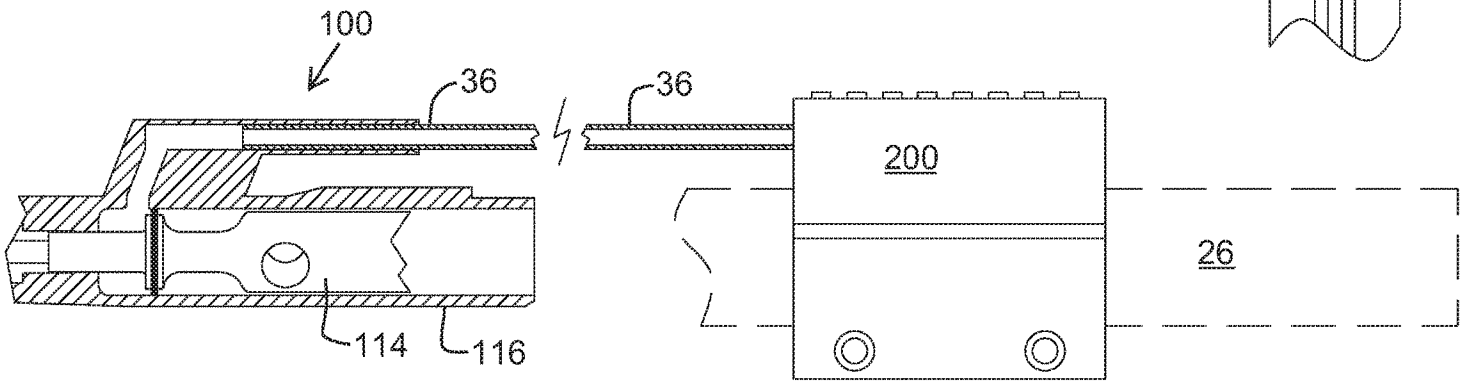

FIG. 14 is a schematic illustration of the present low pressure bolt carrier assembly 100 attached to a rifle (such as an AR-15, M16, and other variants of the COLT AR-15 platform/design), where a portion of the discharge gas from the barrel 26 is redirected back through the gas block 200 and through the gas tube 36.

Figure 16:
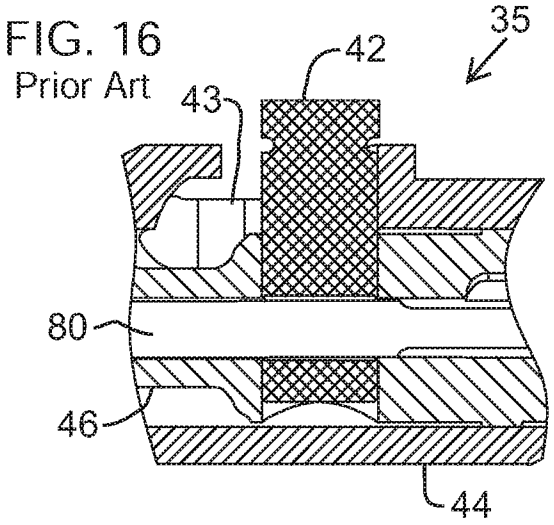
FIG. 16 Prior Art
FIG. 16 is a partial cross-sectional side view of a prior art bolt carrier assembly, showing the cam pin limited to a short stroke by the cam pin bore.
Figure 15:
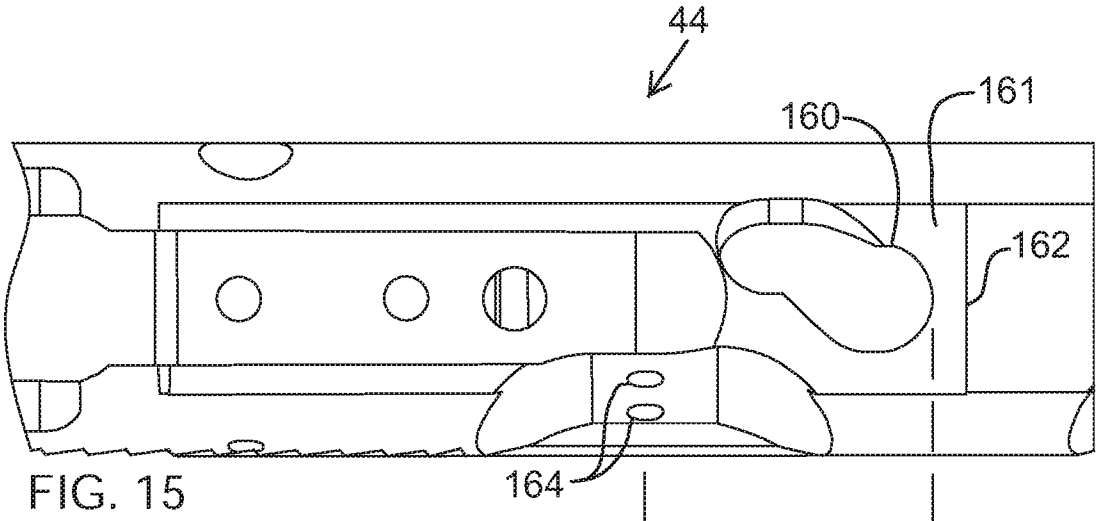
FIG. 15 Prior Art
FIG. 15 is a partial cross-sectional top view of a prior art bolt carrier assembly, showing the standard shorter length of the cam pin bore.

FIGS. 15 and 16 illustrates a prior art bolt carrier 44 and a partial view of a cross-section of a prior art bolt carrier group 35, in order to provide a comparison with the present improved low-pressure bolt carrier 116 and low-pressure bolt carrier group 116 of FIGS. 17 and 18, respectively, and directly below FIGS. 15 and 16. These figures illustrate the present improvements that permit the increased stroke as illustrated in FIGS. 3A-B.

Figure 18:
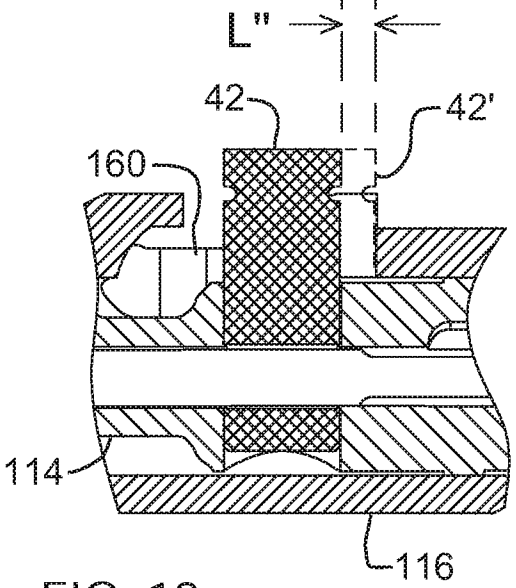
FIG. 18 is a partial cross-sectional side view of the present bolt carrier assembly, showing the cam pin permitted to travel over an increased stroke by the lengthening of the cam pin bore.
Figure 17:
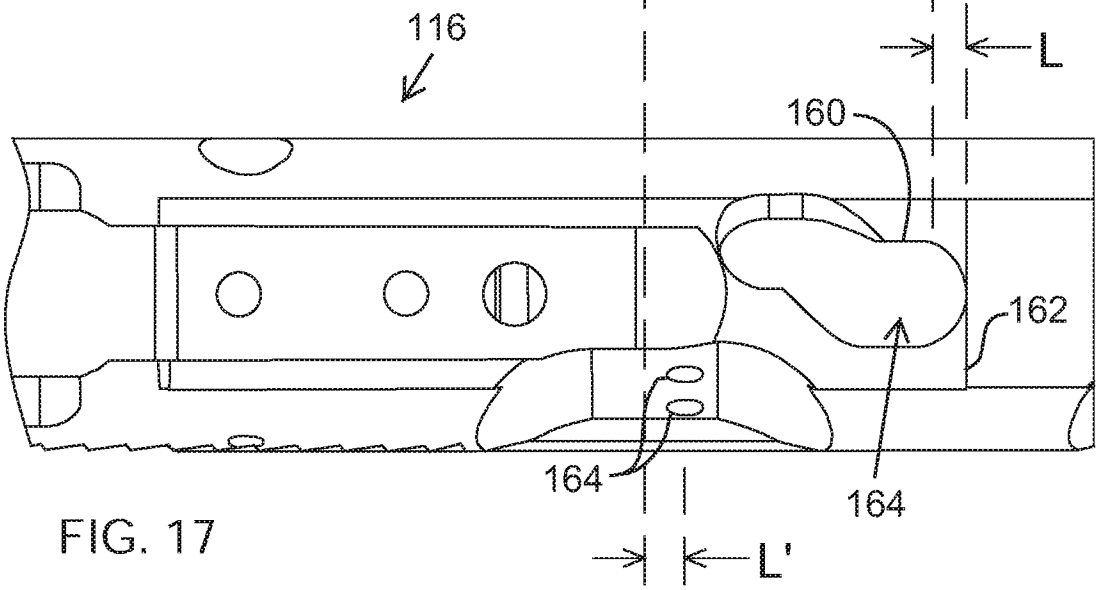
FIG. 17 is a partial top view of the present low pressure bolt carrier, showing the lengthening of the cam pin bore.

FIGS. 17 and 18 illustrate a lengthened cam pin slot 160 where the 0.3165" diameter hole portion 164 of the cam pin slot 160 is axially milled (elongated) toward the charging handle step 162, lengthening the elongated cam pin slot 160 on the top side of the bolt carrier by a distance L. Preferably, the distance L is 0.0787", but may be equal to or less than 0.01", or equal to or less than 0.02", or equal to or less than 0.03", or equal to or less than 0.04", or equal to or less than 0.05", or equal to or less than 0.06", or equal to or less than 0.07". Preferably, the cam pin slot 160 is milled (along the longitudinal axis of the low-pressure bolt carrier 116) to the charging handle step 162 (just breaking through the wall at the tangent) or just short of the charging handle step 162. One or both of the two vent holes 164 may also be repositioned forward (toward the muzzle) by a distance L' or other distance which provides the requisite venting.

In FIG. 18, it can be seen that the elongated cam pin slot 164 provides clearance for the cam pin 42 to move forward (toward the muzzle) further than the cam pin 42 in the standard cam pin slot 43 in FIG. 16 (see the dashed outline of the cam pin 42' moved forward by a distance of L"). The purpose of an elongated cam pin slot 164, is to provide clearance to enable an increase the stroke distance (which will increase by a distance "d"), and thus increases the ratio between the cylinder chamber 106 volume in the initial position and the cylinder chamber 106 volume in the final position, at the full stroke distance, which increases the time over which the gas force acts on the piston surface 144 and the bottom surface 140, thus increasing efficiency.

The present application is a continuation of U.S. patent application Ser. No. 16/178,534, filed on Nov. 1, 2018, which claims the benefit of U.S. provisional application No. 62/579,890, filed on Nov. 1, 2017, both of which are incorporated by reference in their entirety.

Although, the present specification discloses a number of devices and modifications to increase the axial force component acting between the piston surface 144 and the bottom surface 140 to more effectively push the two apart under low-pressure conditions, they may all be combined together in to a single embodiment or one or more of the modifications may be incorporated into an embodiment. Moreover, each component and/or unique improvement may work separately within a standard bolt carrier group. For example, the bolt with the flat piston surface that is substantially perpendicular to the axial movement of the bolt may be sold separately and installed in a standard bolt carrier group to improve low-pressure performance. Similarly, the increased stroke length feature can be employed alone to improve low-pressure performance in a standard bolt carrier group. Thus, each of the disclosed features separately and synergistically together increase axially directed force for the purpose of creating a reliable operating bolt carrier group even under very low-pressure scenarios.

What is claimed is:

1. A low pressure bolt carrier for receiving therein a bolt configured to be restricted to reciprocal axial translation over a stroke distance, the low pressure bolt carrier comprising:

a continuous diameter bolt bore defining a side wall and a bottom wall;

a gas key passage configured to deliver discharge gas into the continuous diameter bolt bore; and a cam slot formed through the side wall having a top slot portion formed on a top of the bolt carrier, the top slot portion of the cam slot has a slot length sufficient to provide clearance to enable reciprocal axial translation of the bolt within the continuous diameter bolt bore.

2. The low pressure bolt carrier of claim 1 wherein, when assembled, the bolt is axially positioned within the continuous diameter bolt bore defining a cylinder chamber between the piston surface and the bottom wall and side wall of the continuous diameter bolt bore.

3. The low pressure bolt carrier of claim 1 wherein the bolt comprises a piston flange formed about a bolt body, the piston flange includes an outer circumferential edge and a bolt tail axially extending from a center portion of the piston flange, a piston surface defined between an outer surface of the bolt tail and the outer circumferential edge.

4. The low pressure bolt carrier of claim 1 wherein the stroke distance is between 0.65 inches and 0.8 inches.

5. The low pressure bolt carrier of claim 1 wherein the stroke distance is between 0.7 inches and 0.76 inches.

6. The low pressure bolt carrier of claim 1 wherein the stroke distance is between 0.73 inches and 0.75 inches.

7. The low pressure bolt carrier of claim 3 wherein at least 50% of the piston surface is flat and substantially perpendicular to the axial movement of the bolt.

8. The low pressure bolt carrier of claim 3 wherein at least 80% of the piston surface is flat and substantially perpendicular to the axial movement of the bolt.

9. The low pressure bolt carrier of claim 3 wherein at least 90% of the piston surface is flat and substantially perpendicular to the axial movement of the bolt.

10. The low pressure bolt carrier of claim 1 wherein a diameter of the continuous diameter bolt bore is at least 0.52 inches.

11. The low pressure bolt carrier device of claim 1 wherein a diameter of the continuous diameter bolt bore is at least 0.53 inches.

12. The low pressure bolt carrier of claim 1 wherein a diameter of the continuous diameter bolt bore is between 0.52 inches and 0.54 inches.

* * * * *